US011090935B2

(12) United States Patent
Nakakubo et al.

(10) Patent No.: US 11,090,935 B2
(45) Date of Patent: Aug. 17, 2021

(54) LIQUID EJECTION MODULE

(71) Applicant: CANON KABUSHIKI KAISHA, Tokyo (JP)

(72) Inventors: Toru Nakakubo, Kawasaki (JP); Akihisa Iio, Yokohama (JP); Rei Kurashima, Yokohama (JP); Takahiro Akiyama, Atsugi (JP); Hiroyuki Ozaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 34 days.

(21) Appl. No.: 16/727,511

(22) Filed: Dec. 26, 2019

(65) Prior Publication Data

US 2020/0207093 A1 Jul. 2, 2020

(30) Foreign Application Priority Data

Dec. 28, 2018 (JP) ..... JP2018-247861
Sep. 24, 2019 (JP) ..... JP2019-172713

(51) Int. Cl.
*B41J 2/14* (2006.01)

(52) U.S. Cl.
CPC .. *B41J 2/14233* (2013.01); *B41J 2002/14419* (2013.01)

(58) Field of Classification Search
CPC ..... B41J 2/14233; B41J 2002/14419; B41J 2202/12; B41J 2202/21; B41J 2/1404; B41J 2/14145
See application file for complete search history.

(56) References Cited

U.S. PATENT DOCUMENTS

2016/0059555 A1* 3/2016 Tamura ..... B41J 2/14233 347/68

FOREIGN PATENT DOCUMENTS

WO 2013/032471 A1 3/2013

OTHER PUBLICATIONS

IP.com search (Year: 2021).*

* cited by examiner

*Primary Examiner* — Lisa Solomon
(74) *Attorney, Agent, or Firm* — Venable LLP

(57) ABSTRACT

A liquid ejection module includes a pressure chamber, a supply flow channel that supplies a liquid to the pressure chamber, a collection flow channel that collects the liquid from the pressure chamber, a liquid feeding chamber connected to one of the supply flow channel and the collection flow channel, and a connection flow channel connecting the liquid feeding chamber to the other of the supply flow channel and the collection flow channel. The liquid feeding chamber includes a liquid feeding mechanism that circulates the liquid in the supply flow channel, the pressure chamber, the collection flow channel, the liquid feeding chamber, and the connection flow channel. A ratio of a sum of flow channel resistance of the supply flow channel, the pressure chamber, and the collection flow channel relative to flow channel resistance of the connection flow channel is equal to or above 0.5.

20 Claims, 7 Drawing Sheets

LIQUID EJECTION MODULE

BACKGROUND OF THE DISCLOSURE

Field of the Disclosure

This disclosure relates to a liquid ejection module.

Description of the Related Art

A liquid ejection module such as an inkjet printing head may cause a problem of deterioration in quality of an ink (a liquid) therein due to a progress in evaporation of a volatile component from an ejection port not used for an ejecting operation for a while for the following reason. Evaporation of the volatile component causes an increase in concentration of a content such as a coloring material. In the case where the coloring material is a pigment, the pigment may develop agglomeration or precipitation, which will adversely affect an ejecting condition as a consequence. More specifically, an amount of ejection or a direction of ejection may vary whereby unevenness in density or streaks may be observed in a printed image.

To suppress the above-mentioned deterioration in quality of the ink, a method of circulating ink inside a liquid ejection module so as to constantly supply fresh ink to an ejection port has been proposed in recent years. International Publication No. WO 2013/032471 discloses a configuration in which an actuator is disposed at a position adjacent to an energy generation element used for ejection, and circulation of ink is promoted at a position very close to an ejection port.

SUMMARY OF THE DISCLOSURE

In a first aspect of the present invention, there is provided a liquid ejection module comprising: a pressure chamber communicating with an ejection port and configured to store a liquid to be ejected from the ejection port; an energy generation element provided in the pressure chamber and configured to generate energy to be used to eject the liquid from the ejection port; a supply flow channel configured to supply the liquid to the pressure chamber; a collection flow channel configured to collect the liquid from the pressure chamber; a liquid feeding chamber connected to the collection flow channel; a connection flow channel connecting the liquid feeding chamber to the supply flow channel; and a liquid feeding unit configured to circulate the liquid in the supply flow channel, the pressure chamber, the collection flow channel, the liquid feeding chamber, and the connection flow channel by expanding and contracting a capacity of the liquid feeding chamber, wherein a ratio of a sum of flow channel resistance values of the supply flow channel, the pressure chamber, and the collection flow channel relative to a flow channel resistance value of the connection flow channel is equal to or above 0.5.

In a second aspect of the present invention, there is provided a liquid ejection module comprising: a pressure chamber communicating with an ejection port and configured to store a liquid to be ejected from the ejection port; an energy generation element provided in the pressure chamber and configured to generate energy to be used to eject the liquid from the ejection port; a supply flow channel configured to supply the liquid to the pressure chamber; a collection flow channel configured to collect the liquid from the pressure chamber; a liquid feeding chamber connected to the collection flow channel; a connection flow channel connecting the liquid feeding chamber to the supply flow channel; and a liquid feeding unit configured to circulate the liquid in the supply flow channel, the pressure chamber, the collection flow channel, the liquid feeding chamber, and the connection flow channel by expanding and contracting a capacity of the liquid feeding chamber, wherein a ratio of a sum of fluid inertance values of the supply flow channel, the pressure chamber, and the collection flow channel relative to a fluid inertance value of the connection flow channel is equal to or above 2.5.

Further features of the present disclosure will become apparent from the following description of exemplary embodiments with reference to the attached drawings.

DESCRIPTION OF THE EMBODIMENTS

However, according to the configuration disclosed in International Publication No. WO 2013/032471, the actuator disposed adjacent to the energy generation element moves up and down in such a way as to compress a flow channel (a pressure chamber), and the pressure chamber at a level that takes into account such an amplitude of the actuator is therefore required. For this reason, energy efficiency for an ejecting operation with the energy generation element may be deteriorated. Meanwhile, since the actuator is disposed in a plane where the ejection port is provided, a thickness of a plate provided with the ejection port is subject to restriction of forming the actuator. This makes it difficult to form the thin ejection port, or in other words, to achieve reduction in size thereof. As a consequence, this configuration has a problem of a large pressure loss inside the ejection port, which may lead to consumption of more energy during the ejection.

This disclosure has been made to solve the aforementioned problems. An object of this disclosure is to provide a liquid ejection module which is capable of performing an ejecting operation stably and at high energy efficiency while circulating and supplying a fresh ink to the vicinity of an ejection port.

Figure 1:
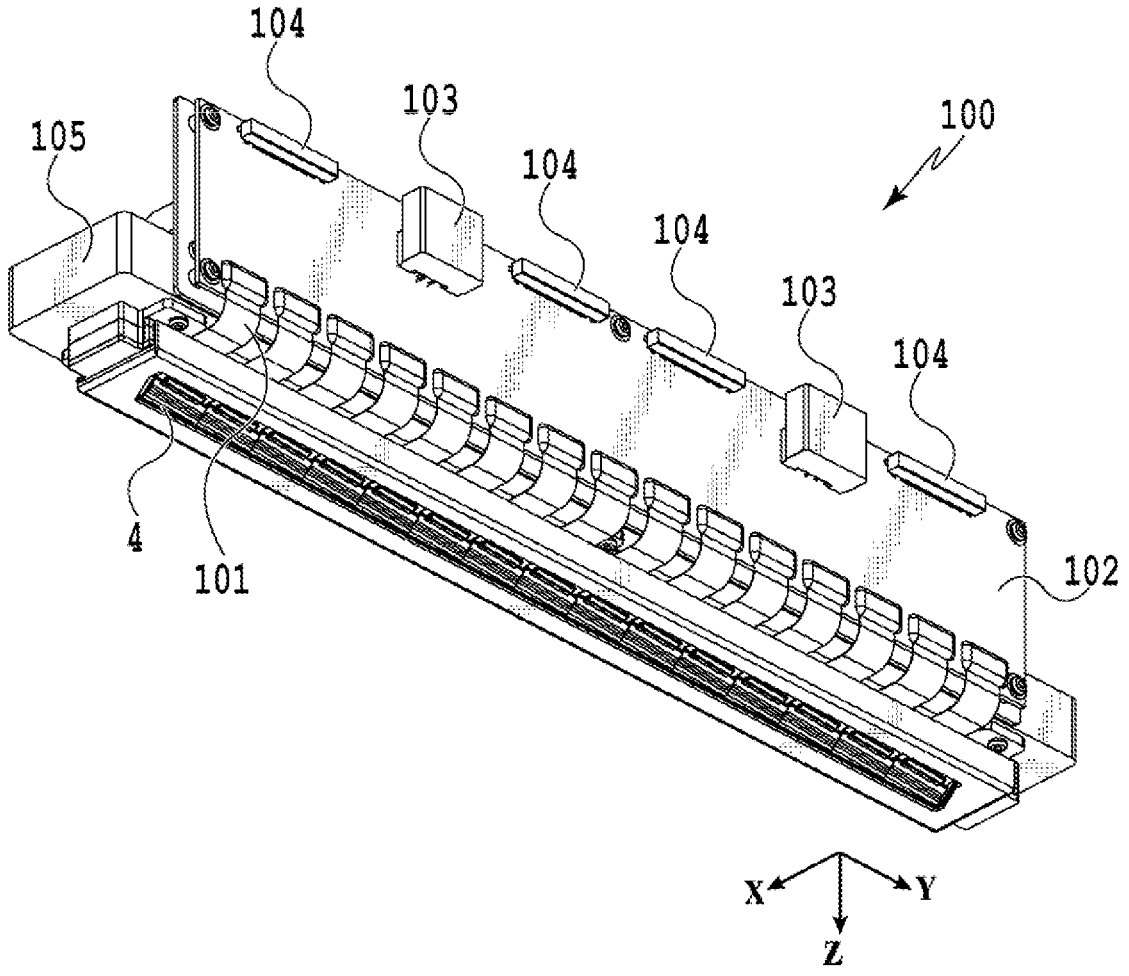
FIG. 1 is a perspective view of an inkjet printing head.

FIG. 1 is a perspective view of an inkjet printing head 100 (hereinafter also simply referred to as a printing head) that can be used as a liquid ejection module of this disclosure. The printing head 100 is formed by arranging element boards 4 in Y direction. Here, each element board includes ejection elements arranged in the Y direction. FIG. 1 illustrates the printing head 100 of a full-line type in which the element boards 4 are arranged in the Y direction over a length corresponding to the width of the A4 size.

The respective element boards 4 are connected to the same electric wiring board 102 through flexible wiring boards 101. The electric wiring board 102 is equipped with power supply terminals 103 for receiving electric power and signal input terminals 104 for receiving ejection signals. Meanwhile, circulation flow channels for forwarding an ink supplied from a not-illustrated ink tank to the respective element boards 4 and collecting the ink not used for printing are formed in an ink supply unit 105.

In this configuration, the respective ejection elements arranged in the element boards 4 eject the ink supplied from the ink supply unit 105 in Z direction of FIG. 1 based on printing data inputted from the signal input terminals 104 and by using the power supplied from the power supply terminals 103.

Figure 2A:
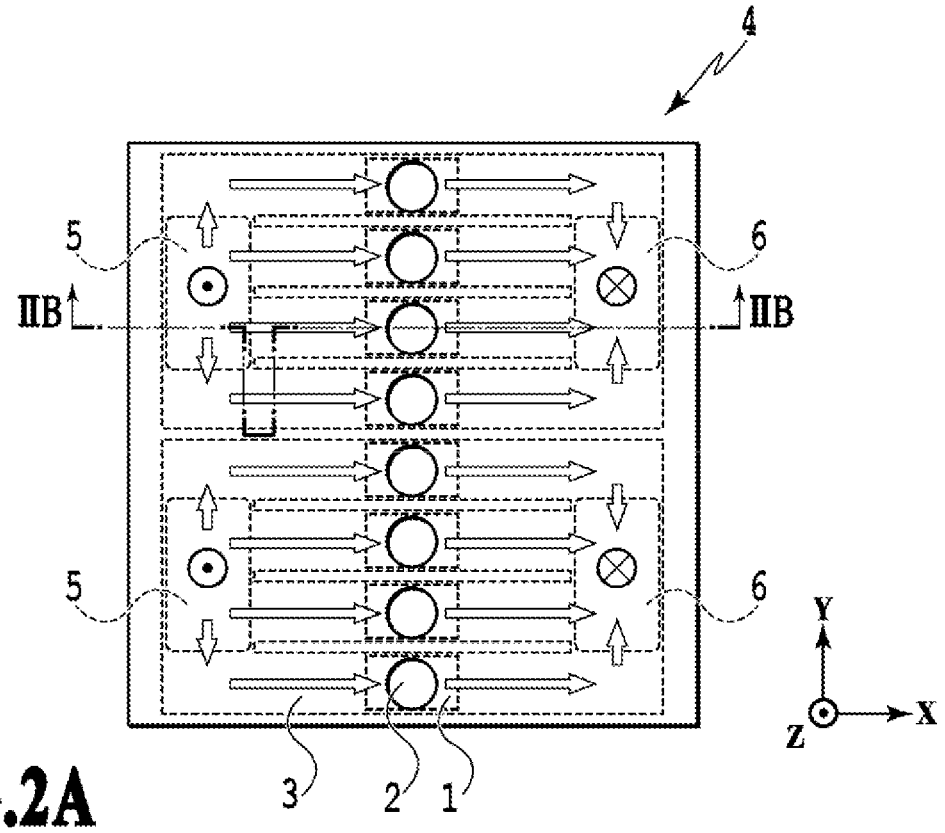
FIGS. 2A and 2B are diagrams showing a flow channel configuration of a flow channel block.
Figure 2B:
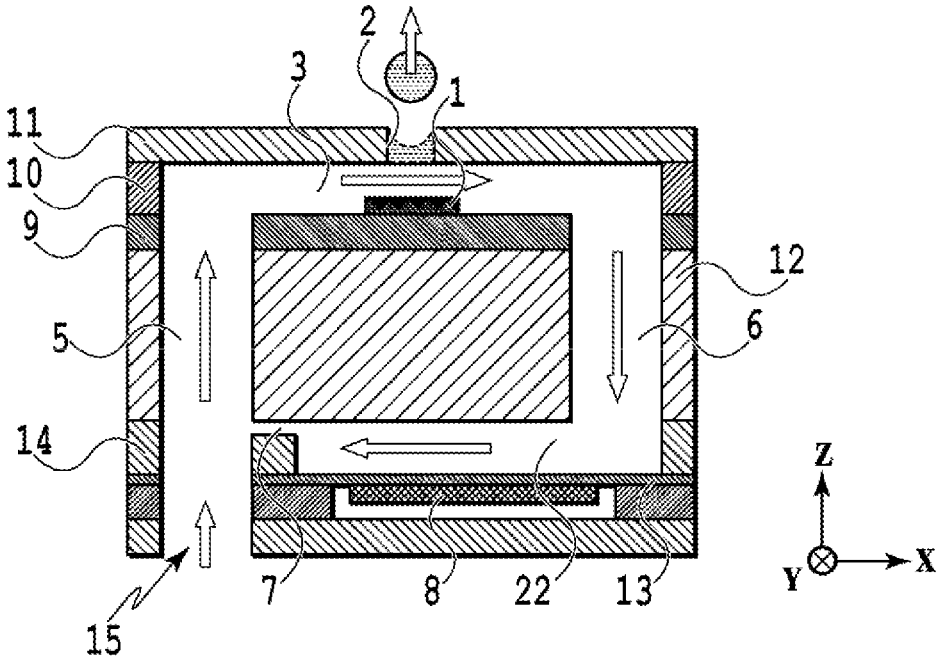

FIGS. 2A and 2B are diagrams showing a flow channel configuration of one flow channel block in the element board 4. Two or more flow channel blocks are formed in each element board 4. FIG. 2A is a transparent view of one of the flow channel blocks viewed from an opposite side (+Z direction side) to an ejection port surface. Meanwhile, FIG. 2B is a cross-sectional view taken along the IIB-IIB line in FIG. 2A.

As shown in FIG. 2A, each flow channel block includes eight ejection ports 2 arranged in the Y direction, eight pressure chambers 3 corresponding to the respective ejection ports, two supply flow channels 5, and two collection flow channels 6. Moreover, each of the two supply flow channels 5 supplies the ink to four of the pressure chambers 3 in common while each of the two collection flow channels 6 collects the ink from four of the pressure chambers 3 in common. Each flow channel block is provided with one liquid feeding mechanism 8 to be described later.

As shown in FIG. 2B, each element board 4 of this embodiment is formed by stacking a second substrate 13, an intermediate layer 14, a first substrate 12, a functional layer 9, a flow channel forming member 10, and an ejection port forming member 11 in the Z direction in this order. An energy generation element 1 serving as an electrothermal conversion element is disposed on a surface of the functional layer 9 while the ejection port 2 is formed at a position in the ejection port forming member 11 corresponding to the energy generation element 1. The flow channel forming member 10 interposed between the functional layer 9 and the ejection port forming member 11 is provided as a partition wall between every two energy generation elements 1 arranged in the Y direction, thus constituting each pressure chamber 3 corresponding to each energy generation element 1 and to each ejection port 2.

The ink in a stable state stored in the pressure chamber 3 forms a meniscus at the ejection port 2. In the case where a voltage pulse is applied to the energy generation element 1 in accordance with an ejection signal, the ink in contact with the energy generation element 1 causes film boiling, and the ink is ejected as a droplet in the Z direction from the ejection port 2 by using growth energy of a bubble thus generated. Assuming that the direction (which is the Z direction in this case) to eject the liquid from the ejection port 2 is a direction from below to above, the ink is ejected from below to above. In actual ink ejection, the ink may be ejected from above to below in the direction of gravitational force. In this case, an upper side in the direction of gravitational force corresponds to the below and a lower side in the direction of gravitational force corresponds to the above. The ink in an amount equivalent to that consumed as a result of an ejecting operation is supplied anew to the pressure chamber 3 by means of capillary forces of the pressure chamber 3 and the ejection port 2, whereby the meniscus is formed again at the ejection port 2. Note that the combination of the ejection port 2, the energy generation element 1, and the pressure chamber 3 will be referred to as an ejection element in this embodiment.

As shown in FIG. 2B, in the element board 4 of this embodiment, circulation flow channels are formed by using the second substrate 13, the intermediate layer 14, the first substrate 12, the functional layer 9, the flow channel forming member 10, and the ejection port forming member 11 as walls, respectively. Here, the circulation flow channels can be categorized into the supply flow channel 5, the pressure chamber 3, the collection flow channel 6, a liquid feeding chamber 22, and a connection flow channel 7.

The pressure chamber 3 is prepared for each ejection element. The supply flow channel 5 and the collection flow channel 6 are prepared for four of the ejection elements in the block. Each supply flow channel 5 supplies the ink to four of the pressure chambers 3 in common while each collection flow channel 6 collects the ink from four of the pressure chambers 3 in common.

Each liquid feeding chamber 22 and each connection flow channel 7 are prepared for every eight ejection elements, that is, for each flow channel block. The liquid feeding chamber 22 is arranged at such a position that overlaps the eight energy generation elements 1 on the XY plane. The liquid feeding chamber 22 is equipped with the liquid feeding mechanism 8 that can change a capacity of the liquid feeding chamber 22. The liquid feeding mechanism 8 circulates the ink in the eight pressure chambers 3 in common. The connection flow channel 7 is disposed almost at the center of the flow channel block in the Y direction and connects the liquid feeding chamber 22 to the supply flow channel. Here, a position of the supply flow channel to be connected to the connection flow channel 7 is a position located upstream of a point where the supply flow channel is branched into the two supply flow channels 5.

Based on the above-described configuration, the ink supplied through a supply port 15 can be circulated to the supply flow channels 5, the pressure chambers 3, the collection flow channels 6, the liquid feeding chamber 22, and the connection flow channel 7 in this order by appropriately driving the liquid feeding mechanism 8. This circulation is conducted stably irrespective of the presence or the frequency of the ejecting operation so that the fresh ink can be constantly supplied to the vicinity of each ejection port 2. Though not illustrated in the drawings, it is preferable to provide a filter in the middle of the supply flow channel in front of each pressure chamber 3 so as to prevent foreign substances, bubbles, and the like from flowing in. A columnar structure or the like can be adopted as such a filter.

The element board 4 can be manufactured by forming the structures in the first substrate 12 and the second substrate 13 in advance, respectively, and then attaching the first substrate 12 and the second substrate 13 to each other while interposing the intermediate layer 14 that includes a groove at a location serving as the connection flow channel 7 later as shown in FIG. 2B. Here, although the connection flow channel 7 is provided between the intermediate layer 14 and the first substrate 12 in FIG. 2B, the connection flow channel 7 may be provided between the intermediate layer 14 and the second substrate instead. To be more precise, the configuration in which the connection flow channel 7 is formed between the intermediate layer 14 and the first substrate 12 as shown in FIG. 2B is obtained by attaching the intermediate layer 14 while directing its surface provided with the groove to the first substrate 12. On the other hand, the configuration in which the connection flow channel 7 is formed between the intermediate layer 14 and the second substrate 13 is formed by attaching the intermediate layer 14 while directing its surface provided with the groove to the second substrate 13.

Note that the liquid feeding chamber 22 and the connection flow channel 7 do not always have to be formed by using the intermediate layer 14, but may instead be formed by etching at least one of the -Z direction side of the first substrate 12 and the +Z direction side of the second substrate 13.

Now, a specific example of dimensions in the above-described structures will be described below. In this embodiment, the respective ejection elements, namely, the energy generation elements 1, the ejection ports 2, and the pressure chambers 3 are arranged at a density of 1200 npi (nozzles per inch) in the Y direction. The size of each energy generation element 1 is set to 32 μm=12 μm. Meanwhile, each ejection port 2 has a diameter of 15 μm. A thickness of the ejection port 2, namely, a thickness of the ejection port forming member 11 is set to 8 μm. The size of each pressure chamber 3 is set to 37 μm in the X direction (length)×17 μm in the Y direction (width)×13 μm in the Z direction (height). Incidentally, the ink used therein has a viscosity of 3 cP and an ink ejection amount from each ejection port is set to 4 pL.

In this embodiment, a driving frequency of each energy generation element 1 is set to 15 kHz. This driving frequency is set up based on a time period required for a sequence including application of a voltage to the energy generation element 1, actual ejection of the ink, and refilling of each ejection element with the new ink in order to enable the next ejecting operation.

In order to keep the viscosity of the ink at the ejection port 2 low enough for maintaining the stable ejecting operation, it is preferable to circulate a portion of the ink located at least a half as high as the height of the ejection port 2. To this end, the following (Formula 1) needs to be satisfied where the height of the pressure chamber 3 is H, the thickness of the ejection port 2 is P, and an opening length (which is usually the diameter) of the ejection port 2 along a circulating flow is W. The example of the dimensions of the above-described embodiment is designed to satisfy the (Formula 1):

$$H^{-0.34}\times P^{-0.66}\times W>1.5 \quad \text{(Formula 1).}$$

Meanwhile, in the element board 4 of this embodiment, the size of the supply flow channel 5 is set to 50 μm in the X direction×30 μm in the Y direction×200 μm in the Z direction. On the other hand, the size of the collection flow channel 6 is set to 25 μm in the X direction×25 μm in the Y direction×200 μm in the Z direction. The size of the connection flow channel 7 is set to 25 μm in the X direction×13 μm in the Y direction×25 μm in the Z direction.

This embodiment is designed to satisfy the relations of dimensions described above so as to set flow channel resistance and inertance of the connection flow channel 7 lower than flow channel resistance and inertance of a flow channel including a combination of the supply flow channels 5, the collection flow channels 6, and the pressure chambers 3. Here, the "flow channel resistance and inertance of the flow channel including a combination of the supply flow channels 5, the collection flow channels 6, and the pressure chambers 3" represents an aggregate of a sum of respective parallel flow channel resistance values of the two supply flow channels 5, the eight pressure chambers 3, and the two collection flow channels 6 and a sum of respective serial flow channel resistance values thereof. Note that the above-mentioned values of the dimensions of the respective components constitute a mere example and may therefore be changed as appropriate depending on the specifications required therefrom.

Figure 3A:
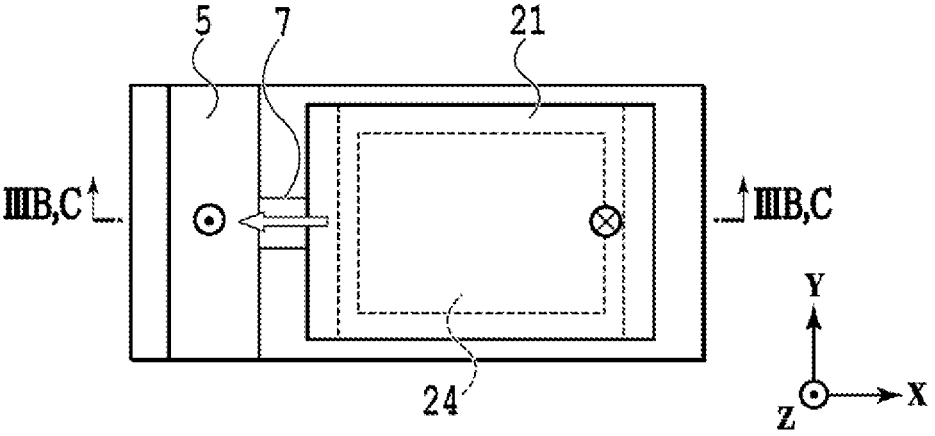
FIGS. 3A to 3C are diagrams for explaining a structure and operations of a liquid feeding mechanism.
Figure 3B:
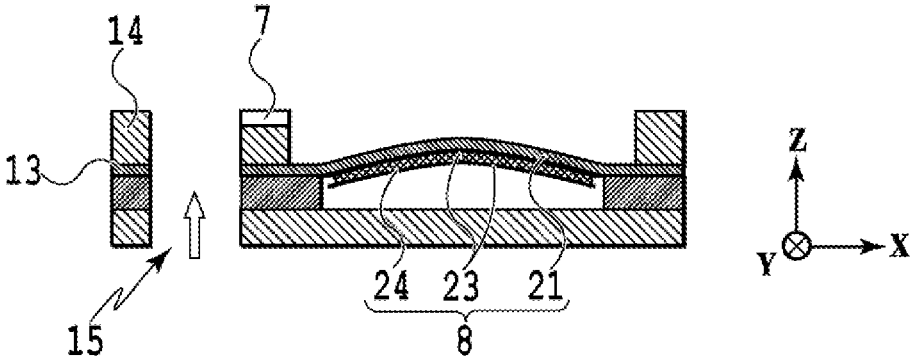
Figure 3C:
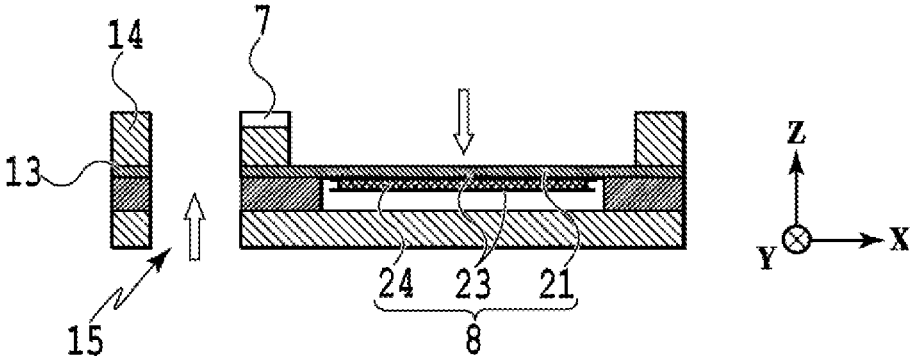

FIGS. 3A to 3C are diagrams for explaining a structure and operations of the liquid feeding mechanism 8. In this embodiment, a piezoelectric actuator which includes a thin-film piezoelectric body 24, two electrodes 23 that sandwich the thin-film piezoelectric body 24 while being located on top and bottom surfaces thereof, and a diaphragm 21 is adopted as the liquid feeding mechanism 8. The liquid feeding mechanism 8 (hereinafter also referred to as an actuator 8) is disposed on the second substrate 13 so as to expose the diaphragm 21 to the liquid feeding chamber 22.

The diaphragm 21 is made of Si or the like in the size of about 250 μm in the X direction×120 μm in the Y direction×2 μm in the Z direction. The thin-film piezoelectric body 24 is a PZT piezoelectric thin film with its thickness around 2 μm. The thin-film piezoelectric body 24 can be deposited in accordance with a sol-gel method, by sputtering, and so forth. Here, it is possible to conduct patterning of the thin-film piezoelectric bodies 24 together with the electrodes 23 and the like on the second substrate 13 by means of photolithography.

In the case where a voltage is applied to the thin-film piezoelectric body 24 through the two electrodes 23, the diaphragm 21 is deflected together with the thin-film piezoelectric body 24 and the capacity of the liquid feeding chamber 22 is thus changed. In other words, it is possible to change the capacity of the liquid feeding chamber 22 by displacing the diaphragm 21 in the ±Z directions while changing the voltage applied to the two electrodes 23.

FIG. 3B shows a default state without the application of the voltage to the thin-film piezoelectric body 24. In the default state, a bias voltage is applied between the electrodes of the thin-film piezoelectric body 24 and the diaphragm 21 projects into the liquid feeding chamber 22. Meanwhile, FIG. 3C shows an expanded state in which a maximum voltage of 30 V is applied to the thin-film piezoelectric body 24. In this case, the driving voltage and the bias voltage cancel each other out whereby the diaphragm 21 is biased to the thin-film piezoelectric body 24 side and the capacity of the liquid feeding chamber 22 is increased more than the capacity in the default state shown in FIG. 3B. The diaphragm 21 is displaced between the default state in FIG. 3B and the expanded state in FIG. 3C depending on the magnitude of the voltage applied to the thin-film piezoelectric body 24.

As described above, the actuator 8 and the energy generation elements 1 are arranged on different planes in the element board 4 of this embodiment. Thus, the displacement of the actuator does not affect the capacity of the pressure chamber 3, unlike the configuration according to International Publication No. WO 2013/032471. Instead, it is possible to improve energy efficiency in the ejection as compared to the configuration according to International Publication No. WO 2013/032471. In the meantime, the plane on which the actuator 8 is arranged and the plane on which the energy generation elements 1 are arranged are displaced from each other in the Z direction in an overlapping fashion in a view from the direction of normal lines to these planes. Accordingly, the ejection elements can be arranged more densely than those in the configuration according to International Publication No. WO 2013/032471. Hence, it is possible to achieve both higher resolution and reduction in size as a consequence.

Incidentally, there is a Helmholtz resonance frequency unique to a system using the actuator. The Helmholtz resonance frequency applicable to the above-described system is 150 kHz. In other words, its Helmholtz period is about 6.7 μsec. This resonance frequency is used to drive the actuator 8 in this embodiment.

Figure 4A:
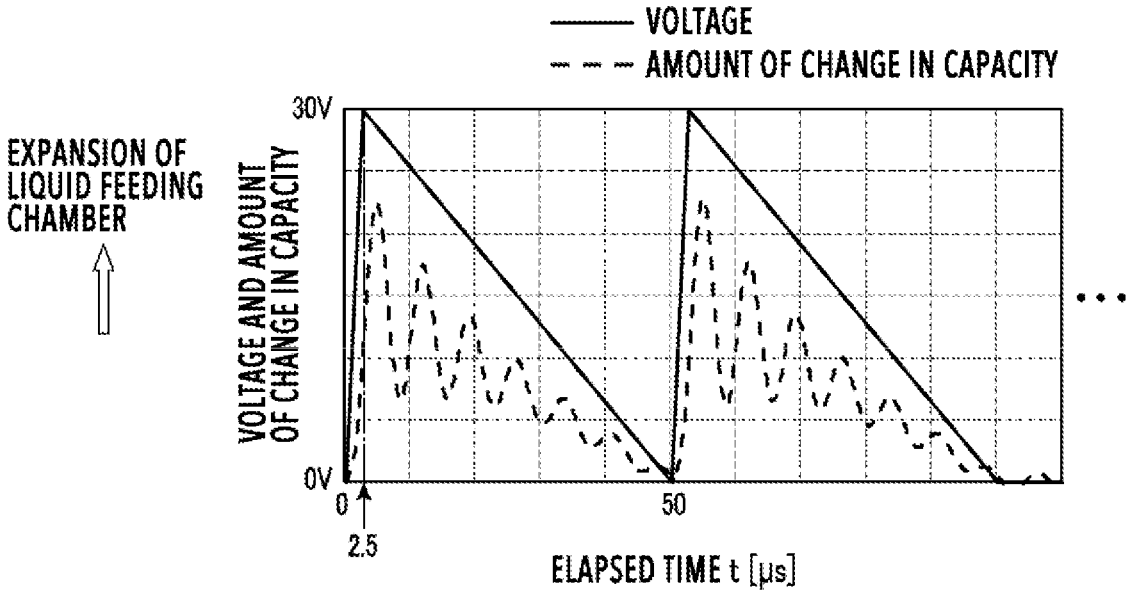
FIGS. 4A and 4B are graphs showing a voltage to be applied to an actuator and an amount of change in capacity of a liquid feeding chamber.
Figure 4B:
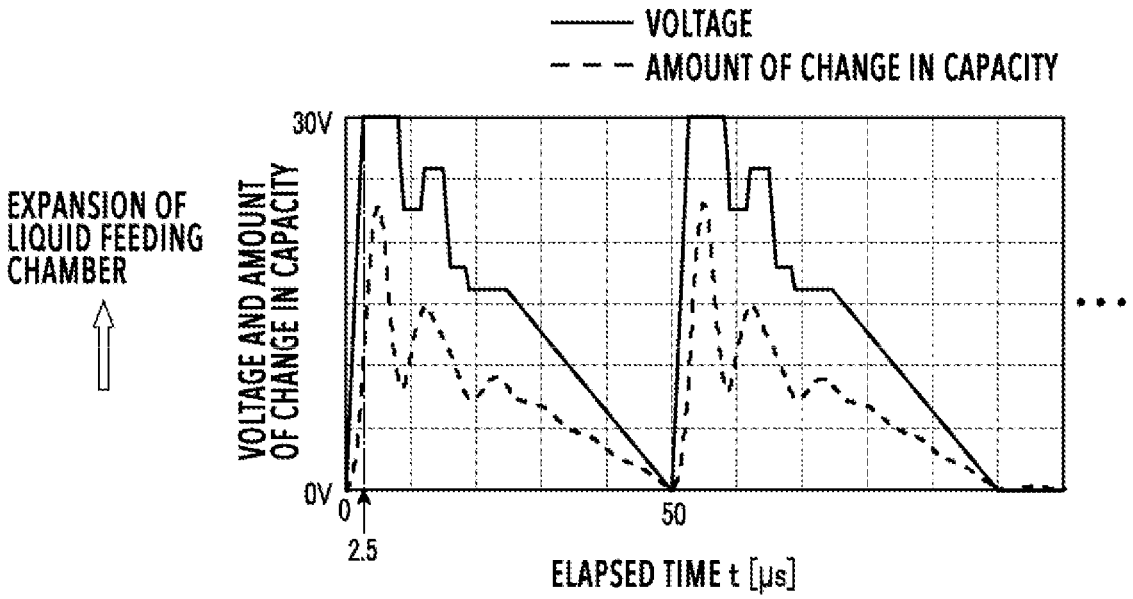

FIGS. 4A and 4B are graphs showing the voltage to be applied for driving the actuator 8 and an amount of change in capacity of the liquid feeding chamber 22 to be increased or decreased depending on the voltage. In each of FIGS. 4A and 4B, the applied voltage is indicated with a solid line while the amount of change in capacity is indicated with a dashed line. Moreover, in each of FIGS. 4A and 4B, a direction of expansion of a volume of the liquid feeding chamber 22 is defined as a positive direction of the voltage, and a maximum voltage is set to 30 V while a driving period is set to 50.0 μsec. That is to say, the driving frequency of the actuator 8 is 20 kHz which is a sufficiently higher value than a driving frequency of the energy generation element which is 15 kHz. In this way, by setting the driving frequency of the actuator 8 sufficiently higher than the driving frequency of the ejection element, it is possible to suppress a variation among respective ejecting operations of the ejection elements due to the driving of the actuator.

Now, the voltage and the amount of change in capacity with respect to an elapsed time period t will be discussed for each of the cases shown in FIGS. 4A and 4B.

In the case of FIG. 4A, the voltage is increased from 0 V to 30 V at a constant gradient during a period from time t=0.0 μsec to start the driving to time t=2.5 μsec. Then, the voltage is decreased from 30 V to 0 V at a constant gradient during a period from the time t=2.5 μsec to time t=50.0 μsec. Thereafter, the aforementioned increase and decrease of the voltage are repeated at a cycle of 50.0 μsec. Here, rise time Δt=2.5 μsec in the case of increasing the voltage is a value adjusted to come close to a half of the Helmholtz period (6.7 μsec).

Here, in the case of focusing on the dashed line indicating the amount of change in capacity, the line shows that the capacity of the liquid feeding chamber 22 is suddenly increased within the rise time Δt=2.5 μsec. This efficient expansion of the liquid feeding chamber 22 is achieved by setting the rise time Δt close to the half of the Helmholtz period (6.7 μsec), or more specifically, by setting the rise time Δt=2.5 μsec. In the meantime, the capacity after the rise time Δt=2.5 μsec gradually reduces its amplitude while repeating the increase and decrease along with residual vibration of the Helmholtz period (6.7 μsec) following the fall in voltage, and eventually returns to the initial value (the amount of change in capacity of 0).

In this case, a rapid flow velocity is obtained in the course of the sudden expansion of the liquid feeding chamber 22, which leads to the large Reynolds number that generates a vortex in the vicinity of the connection flow channel 7. This vortex blocks a flow from the connection flow channel 7 to the liquid feeding chamber 22. On the other hand, a slow flow velocity is obtained in the course of the gradual contraction of the liquid feeding chamber 22, which leads to the small Reynolds number that is likely to cause a parallel flow. As a consequence, the liquid flows out of the liquid feeding chamber 22 to the connection flow channel 7 and to the collection flow channel 6 at a slow velocity as well. This embodiment makes use of generation of such a difference between an inflow velocity to the liquid feeding chamber 22 associated with the sudden expansion and an outflow velocity from the liquid feeding chamber 22 associated with the gradual contraction. Then, a pump function in the actuator 8 is realized by quantifying a flow volume that eventually moves from the liquid feeding chamber 22 to the connection flow channel 7.

Here, if a ratio of the flow volume sent out to the connection flow channel relative to the amount of change in capacity of the liquid feeding chamber 22 is defined as liquid feeding efficiency, then the liquid feeding efficiency accounts for 0.50% in the case of the driving shown in FIG. 4A.

On the other hand, FIG. 4B shows a pulse form and a change in capacity in the case of conducting voltage control in such a way as to cancel out the increase and decrease along with the residual vibration of the Helmholtz period. Regarding a drive pulse of this example as well, the liquid feeding chamber 22 is effectively expanded by setting the rise time Δt=2.5 μsec and increasing the voltage from 0 V to 30 V. Thereafter, however, the voltage is decreased stepwise to 0 V while repeating the decrease and increase or maintenance of the voltage.

To be more precise, the voltage is maintained at 30 V during a period from time t=2.5 μsec to time t=8.0 μsec, and the voltage is decreased from 30 V to 23 V during a period from time t=8.0 μsec to time t=8.7 μsec. Then, the voltage is maintained at 23 V during a period from time t=8.7 μsec to time t=11.4 μsec, and the voltage is increased from 23 V to 26 V during a period from time t=11.4 μsec to time t=11.9 μsec. The voltage is maintained at 26 V during a period from time t=11.9 μsec to time t=14.7 μsec, and the voltage is decreased from 26 V to 18 V during a period from time t=14.7 μsec to time t=16.0 μsec. The voltage is maintained at 18 V during a period from time t=16.0 μsec to time t=18.3 μsec, and the voltage is decreased from 18 V to 16 V during a period from time t=18.3 μsec to time t=18.9 μsec. Moreover, the voltage is maintained at 16 V during a period from time t=18.9 μsec to time t=24.5 μsec, and the voltage is decreased at a constant gradient from 16 V to 0 V during a period from time t=24.5 μsec to time t=50.0 μsec. Thereafter, the above-mentioned increase and decrease are repeated at a cycle of 50.0 μsec.

Here, in the case of focusing on the dashed line indicating the amount of change in capacity, the line shows that the capacity of the liquid feeding chamber 22 is suddenly increased in the rise time Δt=2.5 μsec and then returns to the initial capacity (the amount of change in capacity of 0) after the increase and decrease taking place once or twice. In the case where this example is compared with the dashed line in FIG. 4A, the degree and number of times of the increase and decrease in capacity are apparently reduced more in this example than in the example of FIG. 4A, because the voltage value is controlled in this example in such a way as to withstand the increase and decrease in volume associated with the residual vibration of the Helmholtz period. In the case of the driving shown in FIG. 4B, the liquid efficiency turns out to be 3.20%. Thus, it is possible to improve the liquid feeding efficiency as compared to the case in FIG. 4A. Specifically, after the expansion for the rise time Δt, the capacity of the liquid feeding chamber 22 is gradually changed by increasing, decreasing, and maintaining the voltage in synchronization with the period of the Helmholtz resonance in such a way as to withstand the increase and decrease in volume associated with the residual vibration. Thus, it is possible to improve the liquid feeding efficiency as a consequence.

In the case of the inkjet printing head 100 of this embodiment, in order to maintain the stable ejecting operation at each ejection port, it is preferable to set a circulation flow velocity in the vicinity of the ejection port at least 27 times as large as an evaporation rate from the ejection port, which is broadly equal to 3 mm/sec or above. Moreover, in order to obtain the circulation flow velocity of 3 mm/sec or above, an ink having viscosity of 3 cP needs to achieve the liquid feeding efficiency of 1.00% or above while an ink having viscosity of 10 cP needs to achieve the liquid feeding efficiency of 1.75% or above. In other words, by adopting the driving method shown in FIG. 4B that can obtain the liquid feeding efficiency of 3.20%, it is possible to circulate the ink to the vicinity of the meniscus and to maintain the stable ejecting operation even in the case of using a general ink or in the case of using the ink with the high viscosity around 10 cP.

As a consequence of an investigation conducted by the inventors of this disclosure, it was confirmed that an average flow velocity around 10.0 mm/sec in the vicinity of the ejection port 2 was obtained by adopting the driving method shown in FIG. 4B while using the general ink with the viscosity around 3 cP. Moreover, as a consequence of a similar investigation of a system using the ink with the high viscosity around 10 cP, an average flow velocity around 5.5 mm/sec was confirmed in the vicinity of the ejection port 2.

In this embodiment, the liquid feeding efficiency in the entire circulation flow channels is improved by installing the connection flow channel 7, which has either the flow channel resistance or the fluid inertance being appropriately adjusted, at a position fluidically adjacent to the liquid feeding chamber 22 provided with the actuator 8. A description will be given below of a relation between either the flow channel resistance or the fluid inertance and the liquid feeding efficiency in the connection flow channel 7.

Figure 5A:
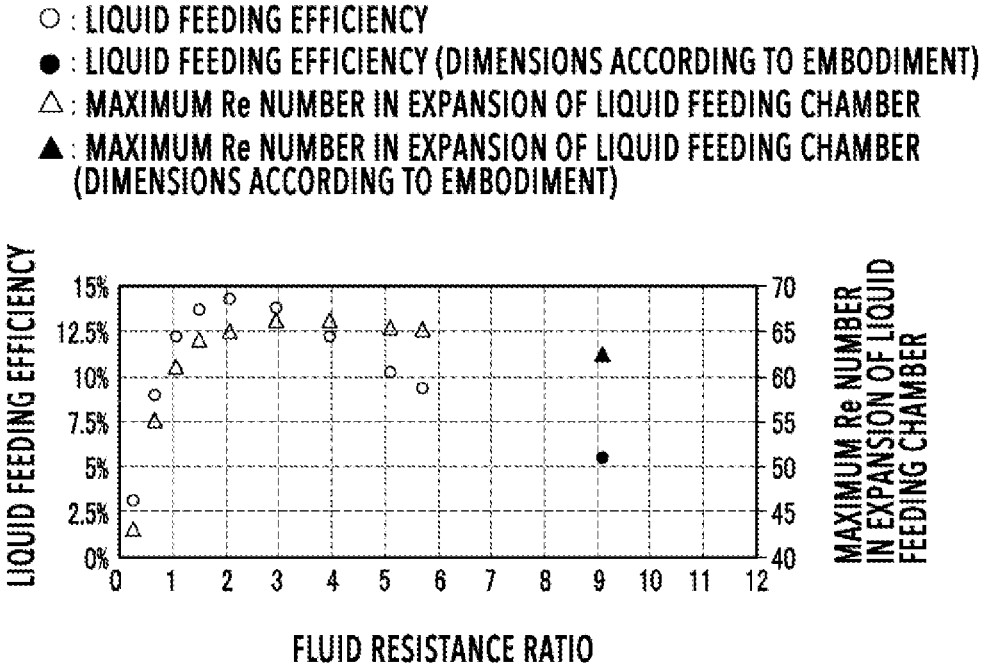
FIGS. 5A to 5C are graphs showing relations among flow channel resistance, fluid inertance, a Reynolds number, and liquid feeding efficiency.
Figure 5B:
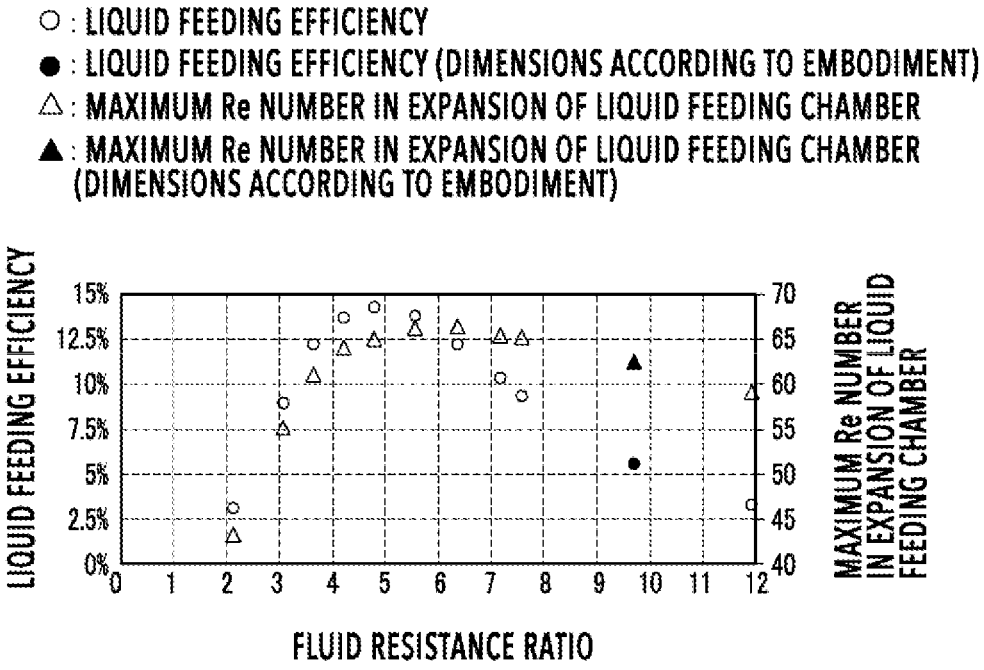
Figure 5C:
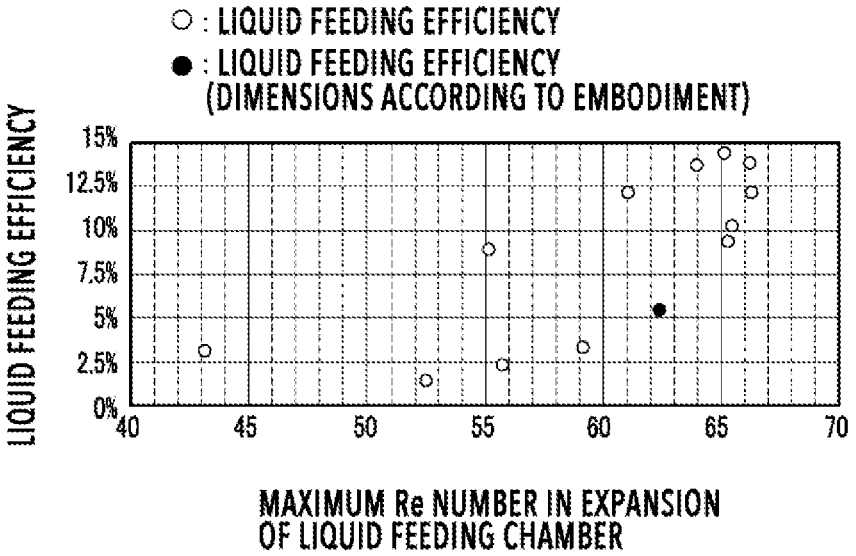

FIGS. 5A to 5C are graphs for explaining relations of the flow channel resistance, the fluid inertance, and a maximum Reynolds number, respectively, with the liquid feeding efficiency regarding the connection flow channel 7. These graphs show results obtained by simulation in the case of using a liquid ejection head shown in FIGS. 1 to 3C. It is to be noted, however, that this simulation is premised on the condition that the actuator 8 is linearly displaced without being affected by the residual vibration. In this case, the liquid feeding efficiency of 5.6% is assumed to be available in the case of driving at the maximum voltage of 30 V based on the aforementioned dimensions. Accordingly, in the case of adopting the driving method shown in FIG. 4B with which the liquid feeding efficiency of 3.20% is available based on the aforementioned dimensions, the actually available liquid feeding efficiency is about 4/7 (≈3.20/5.60) as much as the values indicated in the graphs in FIGS. 5A to 5C.

In FIG. 5A, the horizontal axis indicates a ratio of a sum of flow channel resistance values of the supply flow channels 5, the pressure chambers 3, and the collection flow channels 6 relative to the flow channel resistance of the connection flow channel 7 (hereinafter referred to as a flow channel resistance ratio). This simulation adopts the liquid ejection head shown in FIGS. 1 to 3C as a model. Therefore, the "sum of the flow channel resistance values" represents an aggregate of a sum of the parallel flow channel resistance values of the two supply flow channels 5, the eight pressure chambers 3, and the two collection flow channels 6 with a sum of the serial flow channel resistance values thereof.

In this simulation, the flow channel resistance of the connection flow channel 7 is changed by adjusting a cross-sectional dimension of the connection flow channel 7. Specifically, as it advances to the right on the horizontal axis, the cross-section of the connection flow channel 7 is larger and the flow channel resistance thereof is smaller. FIG. 5A plots the liquid feeding efficiency of the actuator 8 relative to the above-mentioned flow channel resistance ratio, and the maximum Reynolds number (Re) in expansion of the liquid feeding chamber 22, that is, at the rise time Δt. A hydraulic equivalent diameter of the connection flow channel 7 is used as a representative dimension for calculating the Reynolds number.

In the case where the flow channel resistance ratio is 0.3, the Reynolds number Re and the liquid feeding efficiency turn out to be significantly reduced as compared to other plotted positions. This is due to the reason that the flow velocity slows down and the vortex is less likely to be generated as the flow channel resistance of the connection flow channel 7 is increased, and the difference between the inflow velocity into the liquid feeding chamber 22 and the outflow velocity therefrom is less likely to be generated as a consequence. On the other hand, setting the flow channel resistance ratio equal to or above 0.5 brings about significant increases in the Reynolds number Re and in liquid feeding efficiency to such values with which an effect to inhibit an increase in viscosity at the ejection port can be fully expected in the actual use. Moreover, FIG. 5A reveals that it is possible to obtain even more preferable liquid feeding efficiency by setting the flow channel resistance ratio in a range from 0.7 to 6.0 inclusive.

In FIG. 5B, the horizontal axis indicates a ratio of a sum of fluid inertance values of the supply flow channels 5, the pressure chambers 3, and the collection flow channels 6 relative to the fluid inertance of the connection flow channel 7 (hereinafter referred to as a fluid inertance ratio). The fluid inertance of the connection flow channel 7 is changed by adjusting the cross-sectional dimension of the connection flow channel 7. Specifically, as it advances to the right on the horizontal axis, the cross-section of the connection flow channel 7 is larger and the fluid inertance thereof is smaller. FIG. 5B plots the liquid feeding efficiency of the actuator 8 relative to the above-mentioned fluid inertance ratio, and the maximum Reynolds number (Re) in the expansion of the liquid feeding chamber 22. As with the case in FIG. 5A, the hydraulic equivalent diameter of the connection flow channel 7 is used as the representative dimension for calculating the Reynolds number.

In the case where the fluid inertance ratio is 2.1, the Reynolds number Re and the liquid feeding efficiency turn out to be significantly reduced as compared to other plotted positions. This is due to the reason that the difference between the amount of the fluid flowing in and out between the connection flow channel 7 and the liquid feeding chamber 22 and the amount of the fluid flowing in and out between the collection flow channel 6 and the liquid feeding chamber 22 is less likely to be generated in the case where the fluid inertance of the connection flow channel 7 is small. On the other hand, setting the fluid inertance ratio equal to or above 2.5 brings about significant increases in the Reynolds number Re and in liquid feeding efficiency to such values with which the effect to inhibit an increase in viscosity at the ejection port can be fully expected in the actual use. Moreover, FIG. 5B reveals that it is possible to obtain even more preferable liquid feeding efficiency by setting the fluid inertance ratio in a range from 3.0 to 8.0 inclusive.

FIG. 5C is a graph showing a relation between the maximum Reynolds number (Re) in the expansion of the liquid feeding chamber and the liquid feeding efficiency. The maximum Reynolds number (Re) is changed by adjusting the cross-sectional dimension of the connection flow channel 7. A value equal to or above 40 is obtained as the maximum Reynolds number (Re) in the expansion.

Figure 6A:
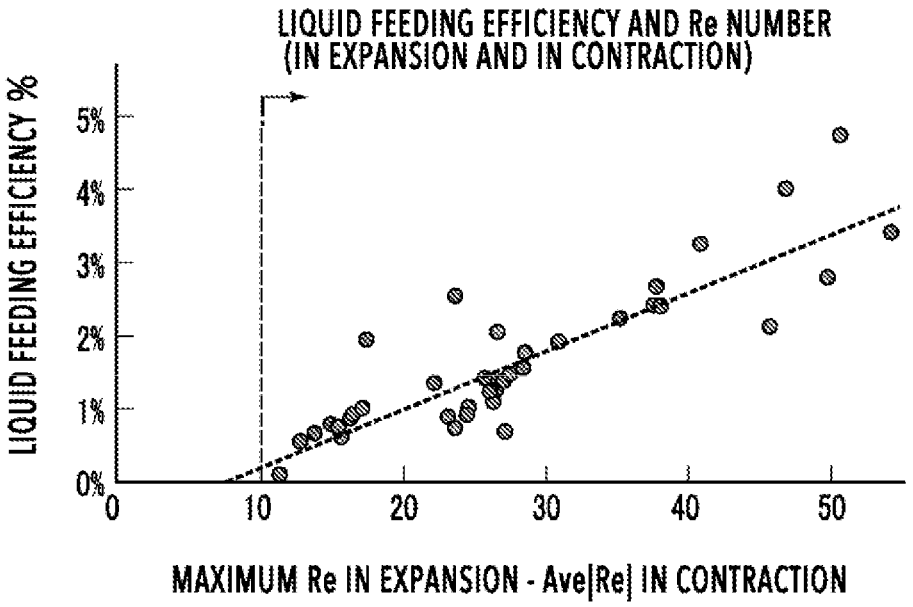
FIGS. 6A and 6B are graphs showing relations among a maximum Reynolds number in expansion, a minimum Reynolds number in contraction, and the liquid feeding efficiency.
Figure 6B:
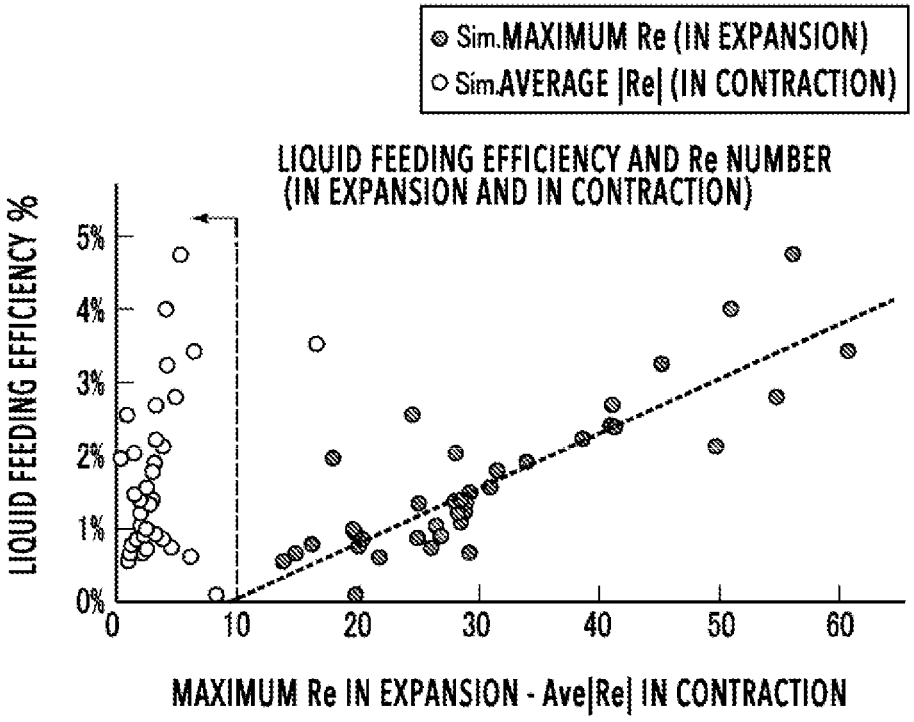

FIGS. 6A and 6B are graphs showing relations among the maximum Reynolds number in the expansion, an average value of absolute values of a minimum Reynolds number (Ave |Re|) in the contraction, and the liquid feeding efficiency. Here, the average |Reynolds number) (Ave|Re|) represents an average value of the absolute values at respective time periods Re(t). The flow in the contraction includes oscillating flows and the use of the absolute value is suitable for expressing the magnitude of the flow. FIG. 6A is a graph showing a difference between the maximum Reynolds number Re in the expansion and the average |Reynolds number| (Ave|Re|) (maximum Reynolds number at time of expansion−average |Reynolds number| at time of contraction). FIG. 6A reveals that the liquid feeding efficiency is obtained in the case where the difference is broadly equal to 10 or above, which enables a function as a pump.

FIG. 6B is a graph plotting the maximum Reynolds number Re in the expansion and the average |Reynolds number| (Ave|Re|) in the contraction separately from each other. The average |Reynolds number| (Ave|Re|) in the contraction of the liquid feeding chamber 22 (displacement of the liquid chamber corresponding to a driving waveform t=2.5 to 50 μs) is equal to or below 10 (about 10 or below). As a consequence, the vortex is generated in the vicinity of the connection flow channel 7 on one of the expansion side and the contraction side where a higher flow velocity is obtained (which is at the time of expansion in this embodiment) whereas no vortex is generated on the side with the lower liquid velocity. Thus, a difference in flow volume is generated between the time of expansion and the time of contraction due to the presence or absence of the vortex. Accordingly, the high liquid feeding efficiency is obtained.

The difference in the Reynolds number between the time of expansion and the time of contraction causes a difference between the inflow amount from the connection flow channel 7 to the liquid feeding chamber 22 and the inflow amount from the liquid feeding chamber 22 to the connection flow channel 7. As a consequence, a constant amount of the ink is transferred from the liquid feeding chamber 22 to the connection flow channel 7. Then, the constant amount grows larger as the maximum Reynolds number (Re) in the expansion of the liquid feeding chamber is larger, and the liquid feeding efficiency can thus be improved.

As described above, the actuator 8 and the energy generation elements 1 are arranged on the different planes in the element board 4 of this embodiment. Accordingly, the displacement of the actuator does not affect the capacity of each pressure chamber 3 or the ejecting operation of each ejection element unlike the configuration of the International Publication No. WO 2013/032471, and it is possible to improve energy efficiency in the ejection as compared to the configuration of International Publication No. WO 2013/032471. In the meantime, the plane on which the actuator 8 is arranged and the plane on which the energy generation elements 1 are arranged are displaced from each other in the Z direction in the overlapping fashion in the view from the direction of the normal lines to these planes. Accordingly, it is possible to achieve the reduction in size while arranging the ejection elements more densely than those in the configuration of International Publication No. WO 2013/032471.

Moreover, according to this disclosure, the liquid feeding efficiency in the entire circulation flow channels is improved by installing the connection flow channel 7, which has either the flow channel resistance or the fluid inertance being appropriately adjusted, at the position connected to the liquid feeding chamber 22 that is provided with the liquid feeding mechanism 8. As a consequence, the ink located in the vicinity of the ejection port 2 is also circulated. Thus, it is possible to suppress the increase in viscosity at the ejection port 2 and to maintain the stable ejecting operation.

According to the above description, the constant amount of flow of the liquid is generated by repeating the sudden expansion and the gradual contraction of the liquid feeding chamber. However, a relation between the lengths of time for the expansion and of time for contraction may be reversed. That is to say, by repeating gradual expansion and sudden contraction of the liquid feeding chamber, it is also possible to circulate the liquid by use of the difference in flow velocity between the time of expansion and the time of contraction. For example, in the case where the time for reducing the voltage is set to as short as about 2.5 μsec, the maximum Reynolds number in the contraction of the liquid feeding chamber 22 becomes equal to or above 40, whereby the vortex is generated in the vicinity of the connection flow channel 7 at the time of contraction of the liquid feeding chamber 22. Then, the average |Reynolds number| in the expansion of the liquid feeding chamber 22 is reduced to 10 or below by allocating the remaining time to the time for increasing the voltage, and the vortex is less likely to be generated. Therefore, by repeating the sudden contraction and the gradual expansion as described above, it is possible to move the constant amount of the ink from the connection flow channel 7 to the liquid feeding chamber 22 in every 50.0 μsec, and thus to generate a circulation flow in the opposite direction from that in the above-described embodiment. In other words, the ink can be circulated at a favorable velocity by setting the maximum Reynolds number equal to or above 10 (more preferably equal to or above 40) at one of the time of expansion and the time of contraction of the capacity of the liquid feeding chamber while setting the average |Reynolds number| equal to or below 10 at the other one of the time of expansion and the time of contraction.

However, in the case of the inkjet printing head of this embodiment, the ejection port 2 needs to be refilled with the ink as soon as possible after the ink therein is consumed by ejection. In this regard, the direction of circulation of this embodiment configured to define the flow channel, which is one of the two flow channels connected to the pressure chamber 3 and directly communicates with the supply port 15, as the supply flow channel seems to be more preferable.

Moreover, the effects of this embodiment have been described above on the assumption of the case of adopting the driving method shown in FIG. 4B. However, this disclosure is not limited only to the driving method shown in FIG. 4B. The waveform of the voltage that can be adopted in order to withstand the increase and decrease in volume associated with the resonance of the Helmholtz period may take on a different shape. Specifically, the widths of rise and fall of the voltage may have values other than those shown in FIG. 4B. Likewise, the time periods required for rise, fall, and maintenance of the voltage are not limited to the values shown in FIG. 4B.

In addition, this disclosure does not always require the employment of the driving waveform that goes against the residual resonance of the Helmholtz period, and may adopt the driving control shown in FIG. 4A, for example. Even by adopting the driving waveform as shown in FIG. 4A, it is still possible to generate the difference in outflow velocity between the time of expansion and the time of contraction as long as the connection flow channel 7 with the flow channel resistance or the fluid inertance being appropriately adjusted is installed at a position fluidically adjacent to the liquid feeding chamber 22. In other words, it is possible to improve the liquid feeding efficiency of the ink as compared to the conventional configuration.

Meanwhile, the flow channel block of this embodiment is not limited only to the mode shown in FIG. 2A. The number of the ejection elements (the pressure chambers 3) to circulate the ink with one liquid feeding mechanism 8 may be more or less than eight. In the meantime, the number of the supply flow channels 5 or the collection flow channels 6 to be provided in each flow channel block may be more or less than two. In general, a unit for circulating the entire flow channels including N×M pieces of the pressure chambers, M pieces of the supply flow channels each configured to supply the liquid to the N pressure chambers in common, and M pieces of the collection flow channels each configured to collect the liquid from the N pressure chambers in common may be defined as one block. Here, each of N and M is an integer equal to or above 1.

Meanwhile, FIGS. 2A and 2B have described the example of the element board 4 in which the ejection elements are arranged in a line in the Y direction. However, two or more lines of the above-described ejection elements may be arranged in the X direction on the element board 4.

In the meantime, in the above-described embodiment, the electrothermal conversion element is used as the energy generation element 1, and the ink is ejected by using the growth energy of the bubble generated by causing the film boiling in the energy generation element 1. However, this disclosure is not limited to the above-described ejecting method. The energy generation element may adopt any of elements of various modes such as the piezoelectric actuator, an electrostatic actuator, a mechanical/impact-drive actuator, a voice coil actuator, and a magnetostriction-drive actuator.

Moreover, the full-line printing head having the configuration in which the element boards 4 are arranged in the Y direction over the length corresponding to the width of the A4 size has been described as the example with reference to FIG. 1. However, the liquid ejection module of this disclosure is also applicable to a serial-type printing head. However, the long printing head such as the full-line type printing head is more apt to develop the problems of this disclosure including the evaporation and deterioration in quality of the ink, and can therefore enjoy the advantageous effects of this disclosure more significantly.

Furthermore, the printing head configured to eject the ink containing a coloring material has been described above as the example. However, the liquid ejection module of this disclosure is not limited only to this configuration. For instance, the module may be configured to eject a transparent liquid prepared for improving image quality, or may be used for purposes other than the printing of images such as for the purpose of uniformly coating a certain liquid on an object. In any case, this disclosure can accomplish its functions effectively in any liquid ejection module configured to eject tiny liquid droplets from multiple ejection ports.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-247861, filed Dec. 28, 2018, and No. 2019-172713 filed Sep. 24, 2019, which are hereby incorporated by reference herein in their entirety.

What is claimed is:

1. A liquid ejection module comprising:

a pressure chamber communicating with an ejection port and configured to store a liquid to be ejected from the ejection port;

an energy generation element provided in the pressure chamber and configured to generate energy to be used to eject the liquid from the ejection port;

a supply flow channel configured to supply the liquid to the pressure chamber;

a collection flow channel configured to collect the liquid from the pressure chamber;

a liquid feeding chamber connected to the collection flow channel;

a connection flow channel connecting the liquid feeding chamber to the supply flow channel; and a liquid feeding unit configured to circulate the liquid in the supply flow channel, the pressure chamber, the collection flow channel, the liquid feeding chamber, and the connection flow channel by expanding and contracting a capacity of the liquid feeding chamber, wherein a ratio of a sum of flow channel resistance values of the supply flow channel, the pressure chamber, and the collection flow channel relative to a flow channel resistance value of the connection flow channel is equal to or above 0.5.

2. The liquid ejection module according to claim 1, wherein the ratio of the sum of the flow channel resistance values of the supply flow channel, the pressure chamber, and the collection flow channel relative to the flow channel resistance value of the connection flow channel is in a range from 0.7 to 6.0 inclusive.

3. The liquid ejection module according to claim 1, wherein the liquid feeding unit is driven such that an expansion rate of the capacity of the liquid feeding chamber is higher than a contraction rate of the capacity of the liquid feeding chamber.

4. The liquid ejection module according to claim 1, wherein a Reynolds number in expansion of the capacity of the liquid feeding chamber and a Reynolds number in contraction of the capacity of the liquid feeding chamber are set such that a difference between a maximum Reynolds number in the expansion of the capacity of the liquid feeding chamber and an average value of absolute values of the Reynolds number in the contraction of the capacity of the liquid feeding chamber is equal to or above 10 and the average value is equal to or below 10.

5. The liquid ejection module according to claim 1, wherein the liquid feeding unit is an actuator including:

a thin-film piezoelectric body, electrodes configured to apply a voltage to the thin-film piezoelectric body, and a diaphragm configured to be displaced with application of the voltage to the thin-film piezoelectric body and to change the capacity of the liquid feeding chamber.

6. The liquid ejection module according to claim 5, wherein a waveform of the voltage to drive the actuator includes a waveform to suppress residual vibration of the diaphragm.

7. The liquid ejection module according to claim 1, wherein a driving frequency of the liquid feeding unit is higher than a driving frequency of the energy generation element.

8. The liquid ejection module according to claim 1, wherein a plane on which the energy generation element is arranged and a plane on which the liquid feeding unit is arranged are located in an overlapping fashion in a view from a direction of normal lines to the planes, and in a case where a direction to eject the liquid from the ejection port is a direction from below to above, the liquid feeding unit is located below the plane on which the energy generation element is arranged.

9. The liquid ejection module according to claim 1, wherein the supply flow channel supplies the liquid to a plurality of the pressure chambers in common, and the collection flow channel collects the liquid from the plurality of the pressure chambers in common.

10. The liquid ejection module according to claim 1, wherein the liquid feeding unit circulates the liquid in a plurality of the pressure chambers in common.

11. The liquid ejection module according to claim 1, further comprising:

a plurality of blocks each including:

a single liquid feeding unit,

M supply flow channels each configured to supply the liquid to N pressure chambers in common, M collection flow channels each configured to collect the liquid from the N pressure chambers in common, and N×M pressure chambers, wherein the N×M pressure chambers, the M supply flow channels, and the M collection flow channels are arranged in parallel, and the plurality of blocks are arranged in parallel.

12. The liquid ejection module according to claim 1, wherein the connection flow channel is provided between a plane on which the energy generation element is arranged and a plane on which the liquid feeding unit is arranged.

13. The liquid ejection module according to claim 1, wherein the liquid feeding unit is driven such that the liquid moves at a velocity of 3 mm/sec or above in the pressure chamber.

14. The liquid ejection module according to claim 1, wherein the liquid is an ink containing a coloring material, and the energy generation element is driven in accordance with printing data.

15. A liquid ejection module comprising:

a pressure chamber communicating with an ejection port and configured to store a liquid to be ejected from the ejection port;

an energy generation element provided in the pressure chamber and configured to generate energy to be used to eject the liquid from the ejection port;

a supply flow channel configured to supply the liquid to the pressure chamber;

a collection flow channel configured to collect the liquid from the pressure chamber;

a liquid feeding chamber connected to the collection flow channel;

a connection flow channel connecting the liquid feeding chamber to the supply flow channel; and a liquid feeding unit configured to circulate the liquid in the supply flow channel, the pressure chamber, the collection flow channel, the liquid feeding chamber, and the connection flow channel by expanding and contracting a capacity of the liquid feeding chamber, wherein a ratio of a sum of fluid inertance values of the supply flow channel, the pressure chamber, and the collection flow channel relative to a fluid inertance value of the connection flow channel is equal to or above 2.5.

16. The liquid ejection module according to claim 15, wherein the ratio of the sum of the fluid inertance values of the supply flow channel, the pressure chamber, and the collection flow channel relative to the fluid inertance value of the connection flow channel is in a range from 3.0 to 8.0 inclusive.

17. The liquid ejection module according to claim 15, wherein the liquid feeding unit is driven such that an expansion rate of the capacity of the liquid feeding chamber is higher than a contraction rate of the capacity of the liquid feeding chamber.

18. The liquid ejection module according to claim 15, wherein the liquid feeding unit is an actuator including:

a thin-film piezoelectric body, electrodes configured to apply a voltage to the thin-film piezoelectric body, and a diaphragm configured to be displaced with application of the voltage to the thin-film piezoelectric body and to change the capacity of the liquid feeding chamber.

19. The liquid ejection module according to claim 15, wherein a plane on which the energy generation element is arranged and a plane on which the liquid feeding unit is arranged are located in an overlapping fashion in a view from a direction of normal lines to the planes, and in a case where a direction to eject the liquid from the ejection port is a direction from below to above, the liquid feeding unit is located below the plane on which the energy generation element is arranged.

20. The liquid ejection module according to claim 15, wherein the liquid feeding unit circulates the liquid in a plurality of the pressure chambers in common.

* * * * *